US010041760B2

(12) United States Patent
Keller, II

(10) Patent No.: US 10,041,760 B2
(45) Date of Patent: Aug. 7, 2018

(54) ADJUSTABLE RIFLE STOCK

(71) Applicant: Safety Harbor Firearms Inc., Safety Harbor, FL (US)

(72) Inventor: Walter W. Keller, II, Safety Harbor, FL (US)

(73) Assignee: SAFETY HARBOR FIREARMS INC., Safety Harbor, FL (US)

( * ) Notice: Subject to any disclaimer, the term of this patent is extended or adjusted under 35 U.S.C. 154(b) by 0 days.

(21) Appl. No.: 15/428,201

(22) Filed: Feb. 9, 2017

(65) Prior Publication Data

US 2017/0241737 A1 Aug. 24, 2017

Related U.S. Application Data

(60) Provisional application No. 62/297,135, filed on Feb. 18, 2016.

(51) Int. Cl.
*F41C 23/14* (2006.01)
*F41A 3/66* (2006.01)

(52) U.S. Cl.
CPC ..... *F41C 23/14* (2013.01); *F41A 3/66* (2013.01)

(58) Field of Classification Search
CPC ..... F41C 23/00; F41C 23/14; F41A 3/66
See application file for complete search history.

(56) References Cited

U.S. PATENT DOCUMENTS 8,353,123 B2 * 1/2013 Pullicar ..... F41A 9/72 42/71.01
2004/0211104 A1 * 10/2004 Eberle ..... F41C 23/00 42/71.02
2016/0349013 A1 * 12/2016 Ley ..... F41G 11/003

OTHER PUBLICATIONS

"Picatinny Buffer Tube Adapter", Oct. 24, 2015, thordsencustoms.com.*
"Picatinny Buffer Tube Adapter", Oct. 24, 2015, thordsencustoms.com (Year: 2015).*
Alan Thordsen, Picatinny Buffer Tube Adapter Sales Page, All Pages, Oct. 20 2015, Alan Thordsen, Diamond Springs CA.

* cited by examiner

*Primary Examiner* — Stephen Johnson
*Assistant Examiner* — Joshua T Semick
(74) *Attorney, Agent, or Firm* — Bennet K. Langlotz; Langlotz Patent & Trademark Works, Inc.

(57) ABSTRACT

An adjustable firearm stock has a body defining an elongated channel adapted to receive a rail, the channel having an internal width adapted to receive the width of the head portion of the rail, and opposed elongated hook surfaces defining a hook width adapted to receive the neck of the rail, the hook surfaces bear on the rail to resist separation of the body from the rail, the channel having an elongated floor surface parallel to and opposing the planar mounting surface of the rail, a foot element connected to the body and having a contact surface facing the planar mounting surface of the rail, and a securement facility operably connected to the foot element and to the body, and operable to move the foot with respect to the body to compress the rail between the contact surface of the foot and the hook surfaces.

19 Claims, 9 Drawing Sheets

ADJUSTABLE RIFLE STOCK

CROSS-REFERENCE TO RELATED APPLICATION

This application claims the benefit of U.S. Provisional Patent Application No. 62/297,135 filed on Feb. 18, 2016, entitled "KES INSTALLATION WITH INTERNAL ATTACHMENT TENSIONING BLOCK," which is hereby incorporated by reference in its entirety for all that is taught and disclosed therein.

FIELD OF THE INVENTION

The present invention relates to firearms, and more particularly to a firearm stock with an extended position and a collapsed position that attaches to a Picatinny rail on the rear of a lower receiver.

BACKGROUND OF THE INVENTION

A firearm stock is the portion of a rifle or other firearm that is held against the user's shoulder when discharging the firearm. The stock enables the user to firmly support the firearm and aim it accurately. The stock also conveys recoil to the user's body.

Because the stock's length determines the pull length (the distance from the user's shoulder to the trigger) and can be a significant factor in the overall length of the firearm, a collapsible stock that provides at least two different pull lengths in an extended position and a collapsed position is highly desirable. The ability to adjust the pull length accommodates individual user's preferences, along with varying thickness of body armor and other attire. The collapsed position that decreases the overall length of the firearm also facilitates firearm operation in confined spaces and enables more compact storage of the firearm when the firearm is not in use. A firearm with a shorter stock when stored can also enable the use of standard length storage containers even when accessories that increase the overall length of the firearm, such as a suppressor, are installed.

Although many folding and adjustable firearm stocks are known, they often have the disadvantage of requiring professional installation. Some prevent the firearm from being discharged when in their folded or collapsed position. Others do not precisely fit the host firearm or can loosen over time from recoil forces, thereby adversely affecting accuracy and/or conveying the appearance of a poor-fitting, low-quality stock even if the firearm's accuracy is not adversely affected.

Therefore, a need exists for a new and improved adjustable firearm stock with an extended position and a collapsed position that attaches to a Picatinny rail on the rear of a lower receiver. In this regard, the various embodiments of the present invention substantially fulfill at least some of these needs. In this respect, the adjustable firearm stock according to the present invention substantially departs from the conventional concepts and designs of the prior art, and in doing so provides an apparatus primarily developed for the purpose of enabling the stock to have an extended position and a collapsed position and attach to a Picatinny rail on the rear of a lower receiver.

SUMMARY OF THE INVENTION

The present invention provides an improved adjustable firearm stock, and overcomes the above-mentioned disadvantages and drawbacks of the prior art. As such, the general purpose of the present invention, which will be described subsequently in greater detail, is to provide an improved adjustable firearm stock that has all the advantages mentioned above.

To attain this, the preferred embodiment of the present invention essentially comprises a body defining an elongated channel adapted to receive a rail, the channel having an internal width adapted to receive the width of the head portion of the rail, the channel having opposed elongated hook surfaces defining a hook width adapted to receive the neck of the rail, the hook width being less than the head width such that the hook surfaces bear on the rail to resist separation of the body from the rail in a direction perpendicular to the planar mounting surface, the channel having an elongated floor surface parallel to and opposing the planar mounting surface of the rail, a foot element connected to the body and having a contact surface facing the planar mounting surface of the rail, and a securement facility operably connected to the foot element and to the body, and operable to move the foot with respect to the body and to compress the rail between the contact surface of the foot and the hook surfaces. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
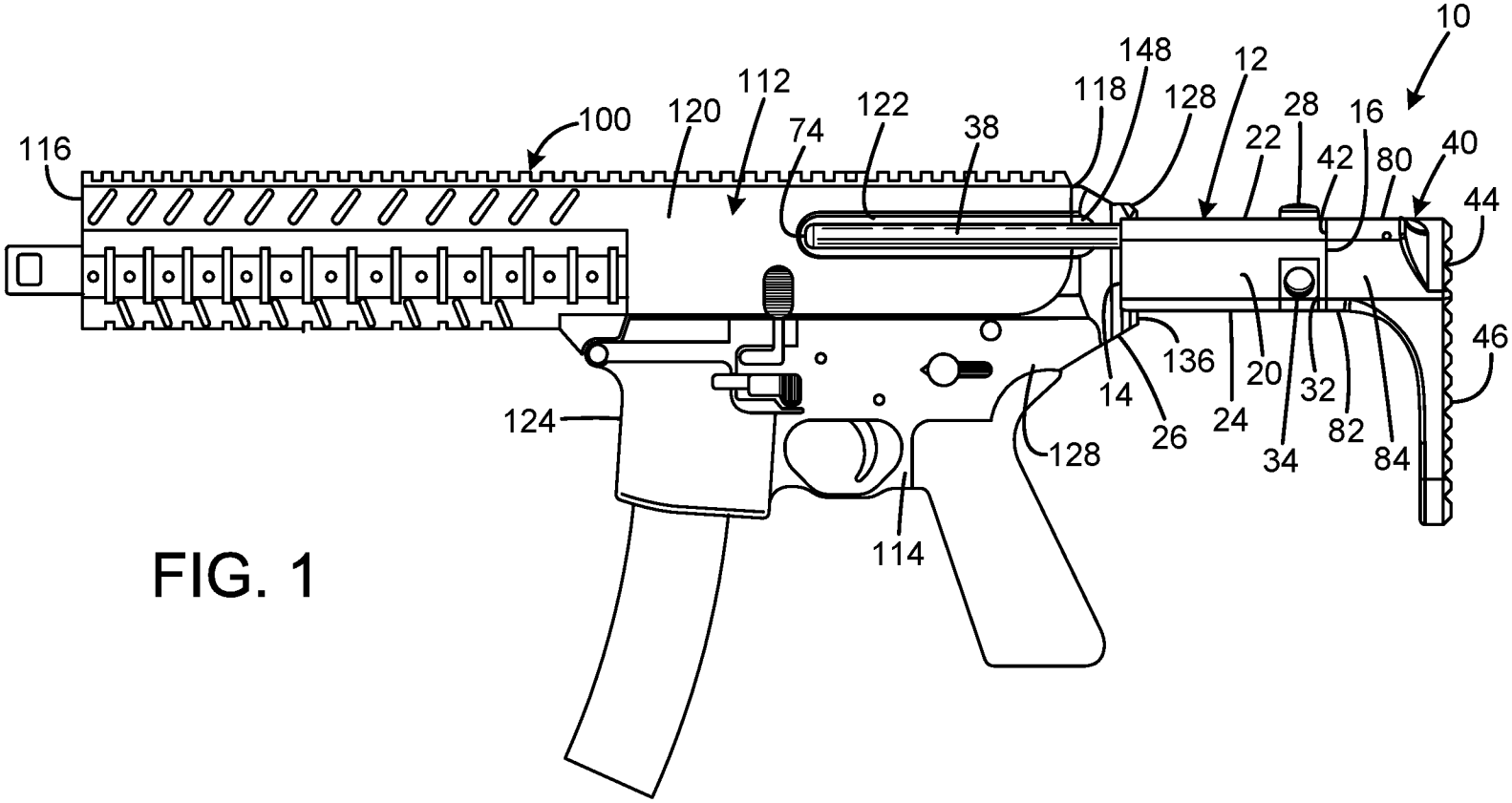
FIG. 1 is a left side view of the current embodiment of the adjustable firearm stock constructed in accordance with the principles of the present invention attached to a firearm.

An embodiment of the adjustable firearm stock of the present invention is shown and generally designated by the reference numeral 10.

Figure 2:
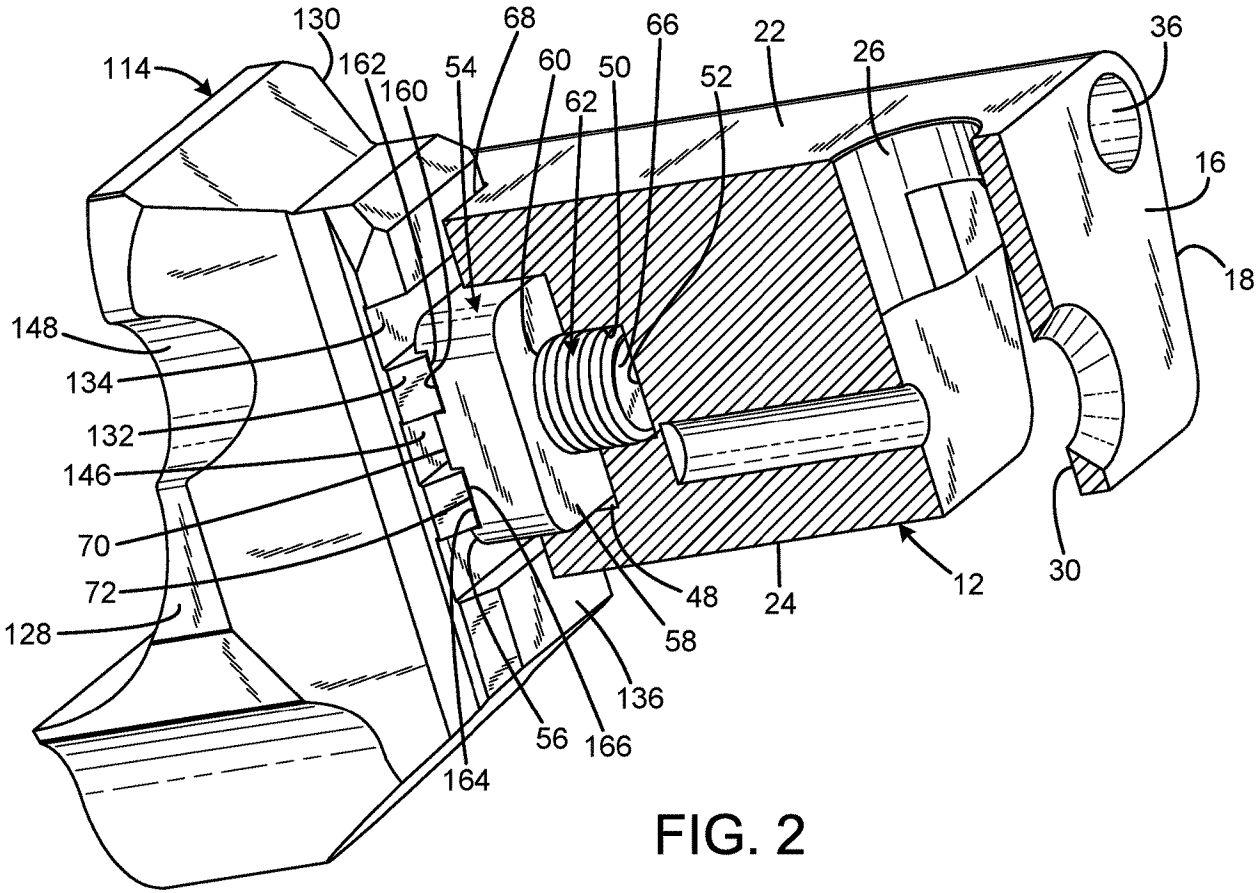
FIG. 2 is a rear isometric cutaway view of the current embodiment of the stock body of FIG. 1 with the locking block in the locked position.
Figure 3:
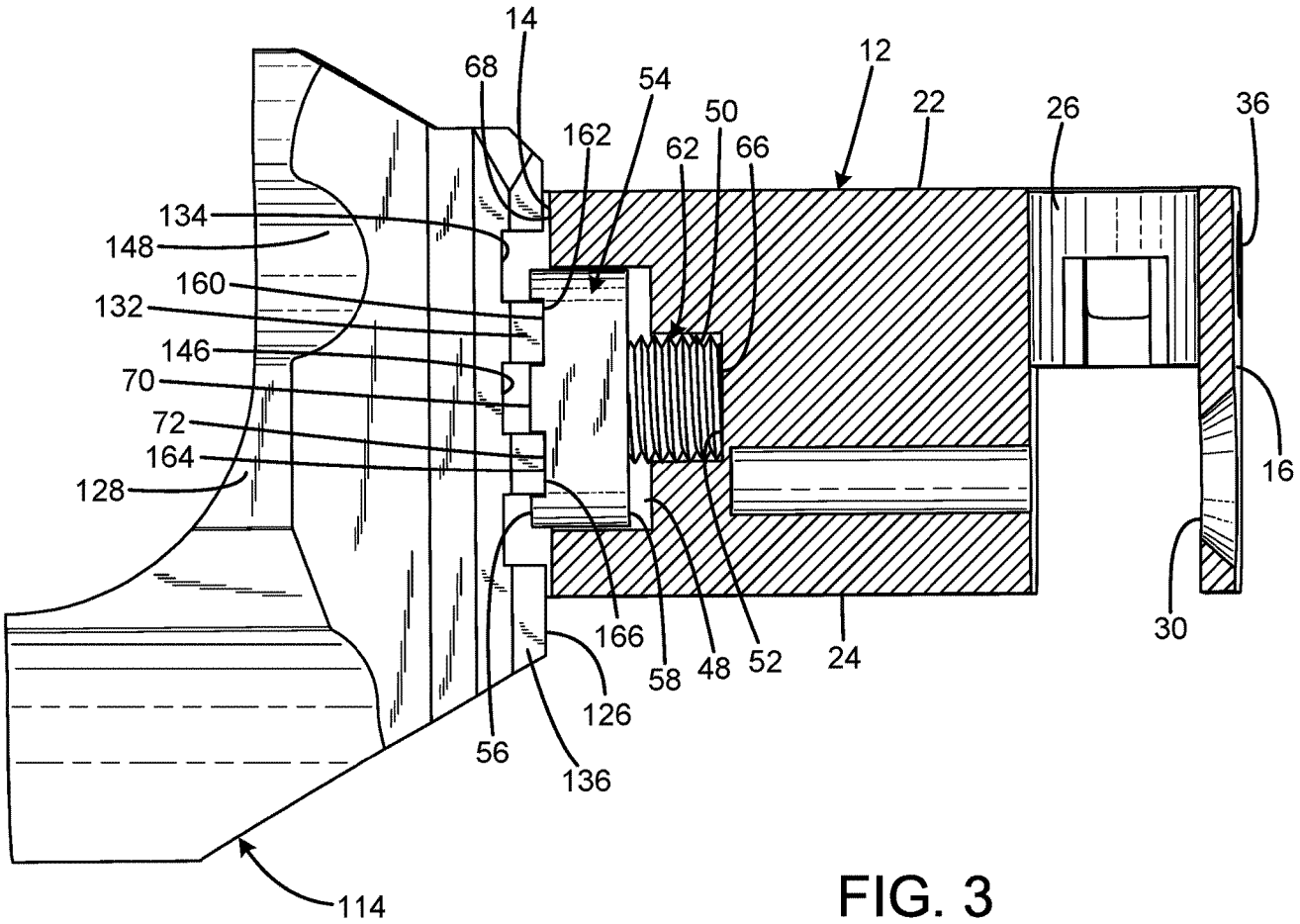
FIG. 3 is a left side cutaway view of the current embodiment of the stock body of FIG. 1 with the locking block in the locked position.
Figure 4:
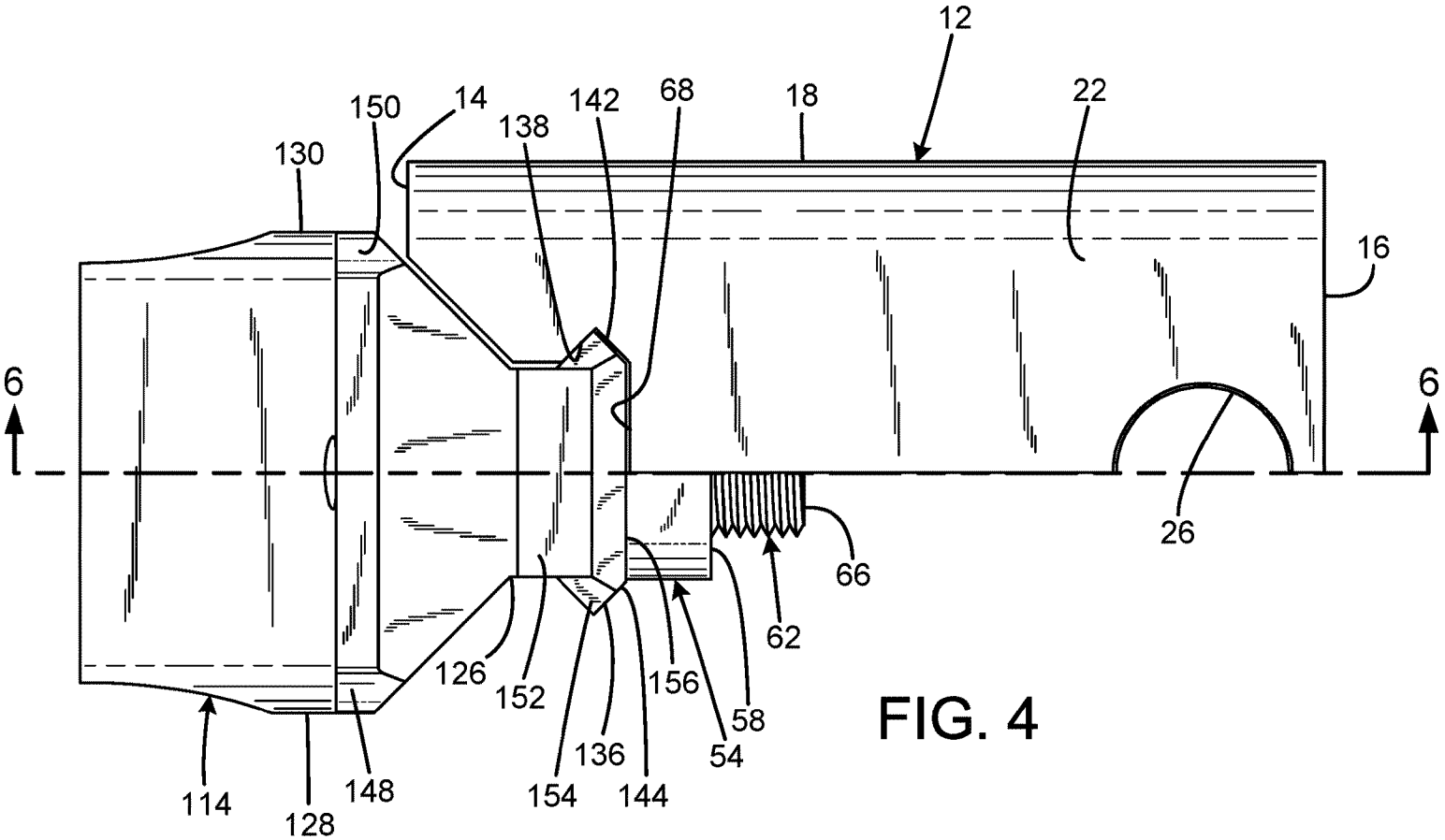
FIG. 4 is a top cutaway view of the current embodiment of the stock body of FIG. 1 with the locking block in the locked position.
Figure 5:
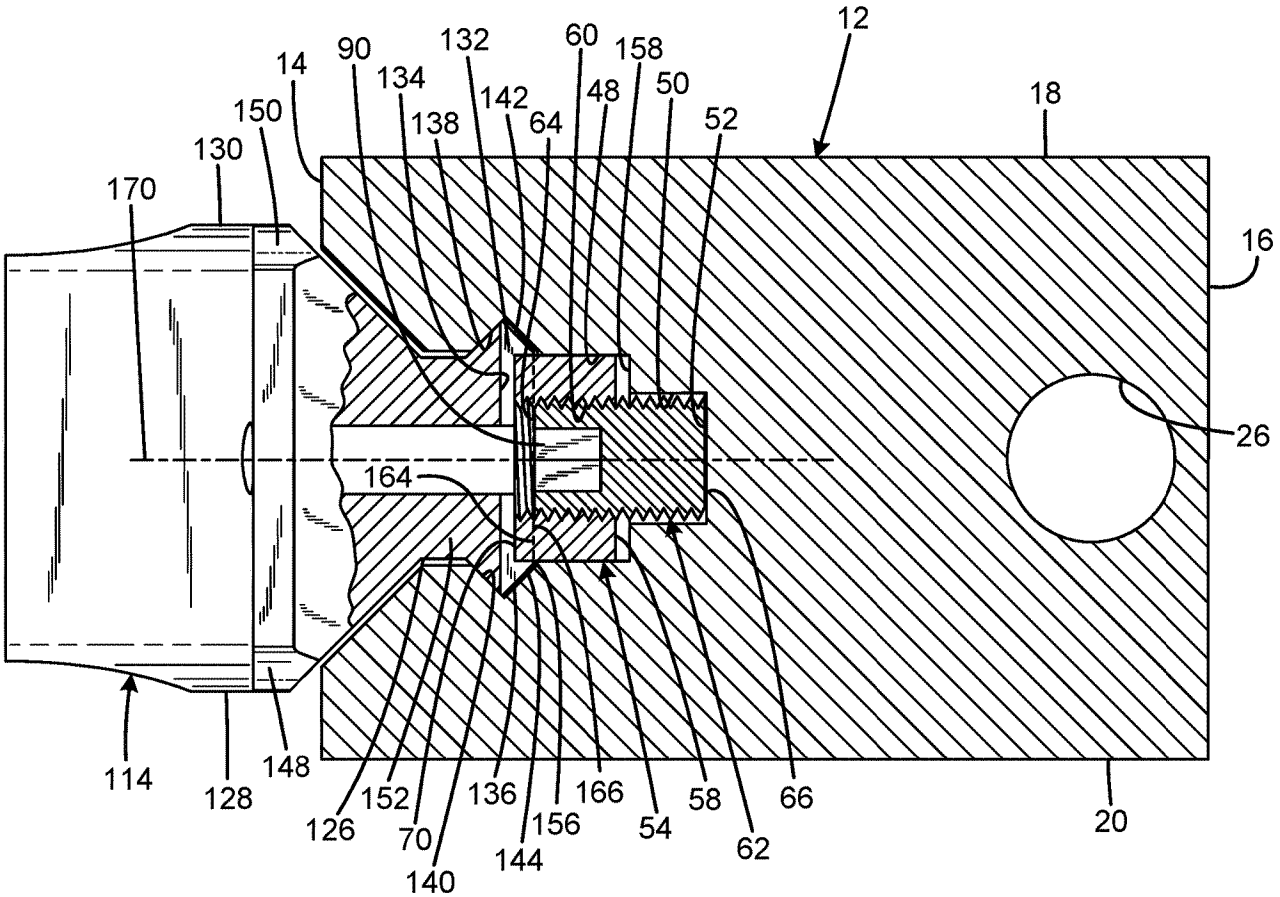
FIG. 5 is a top sectional view of the current embodiment of the stock body of FIG. 1 with the locking block in the locked position.
Figure 6:
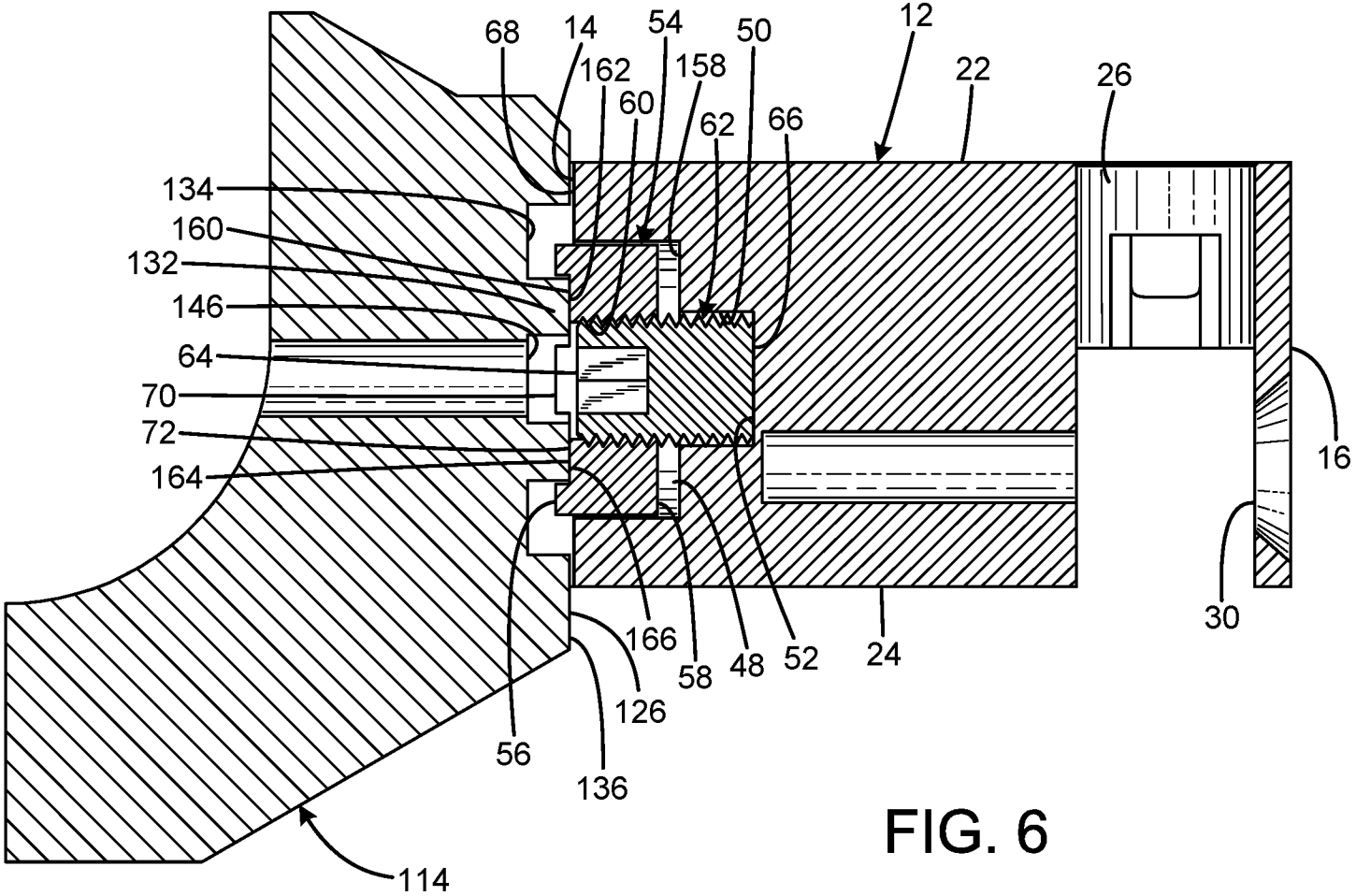
FIG. 6 is a side sectional view of the current embodiment of the stock body taken along line 6-6 of FIG. 4 with the locking block in the locked position.
Figure 7:
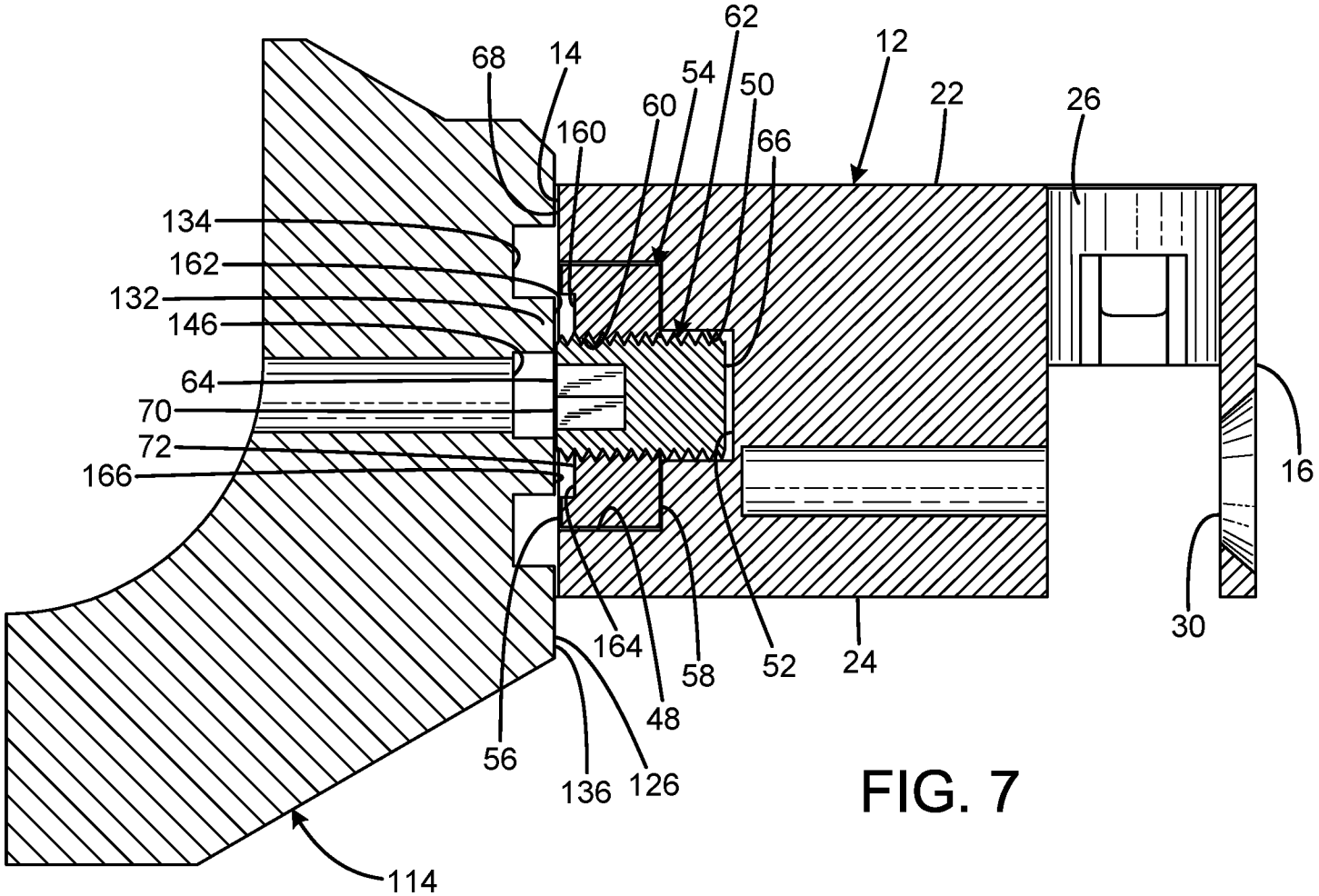
FIG. 7 is a side sectional view of the current embodiment of the stock body with the locking block in the unlocked position.
Figure 8:
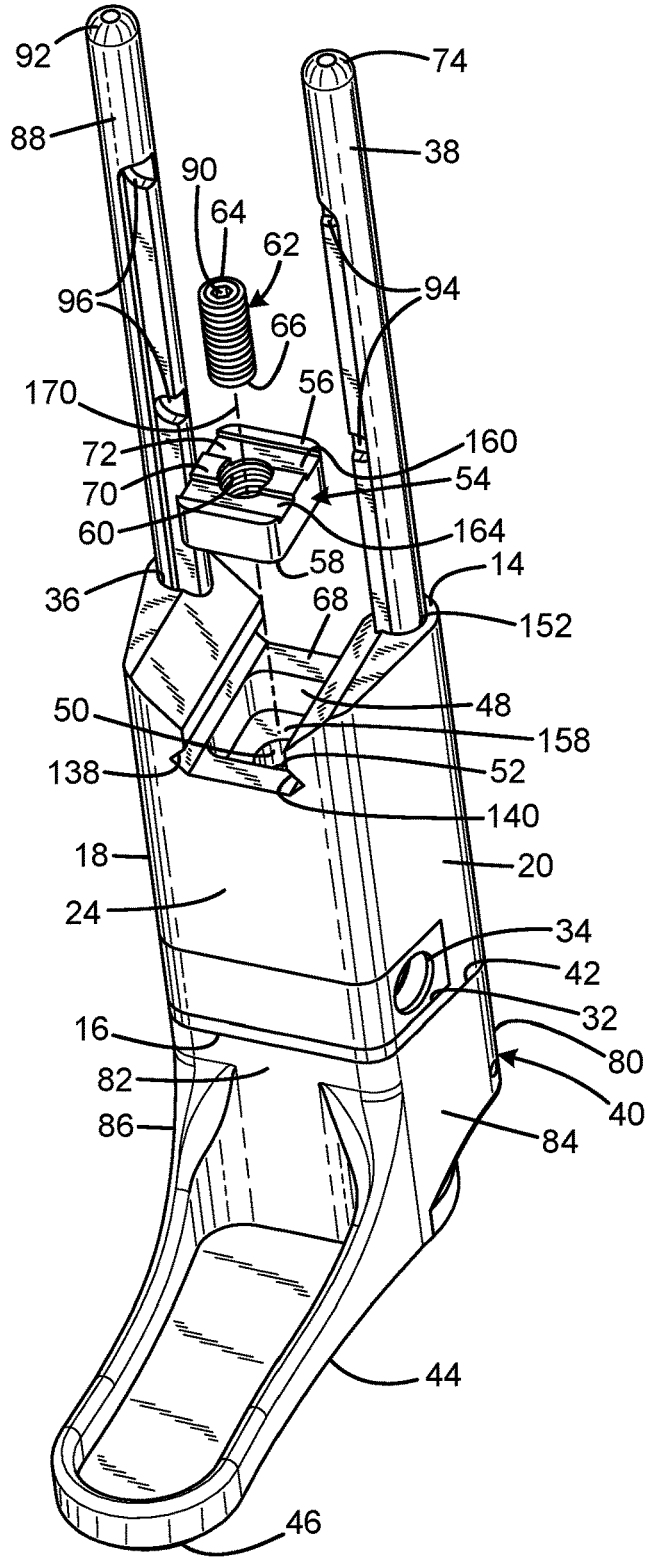
FIG. 8 is an exploded isometric view of the current embodiment of the adjustable firearm stock of FIG. 1 with the stock body in the collapsed position.
Figure 9:
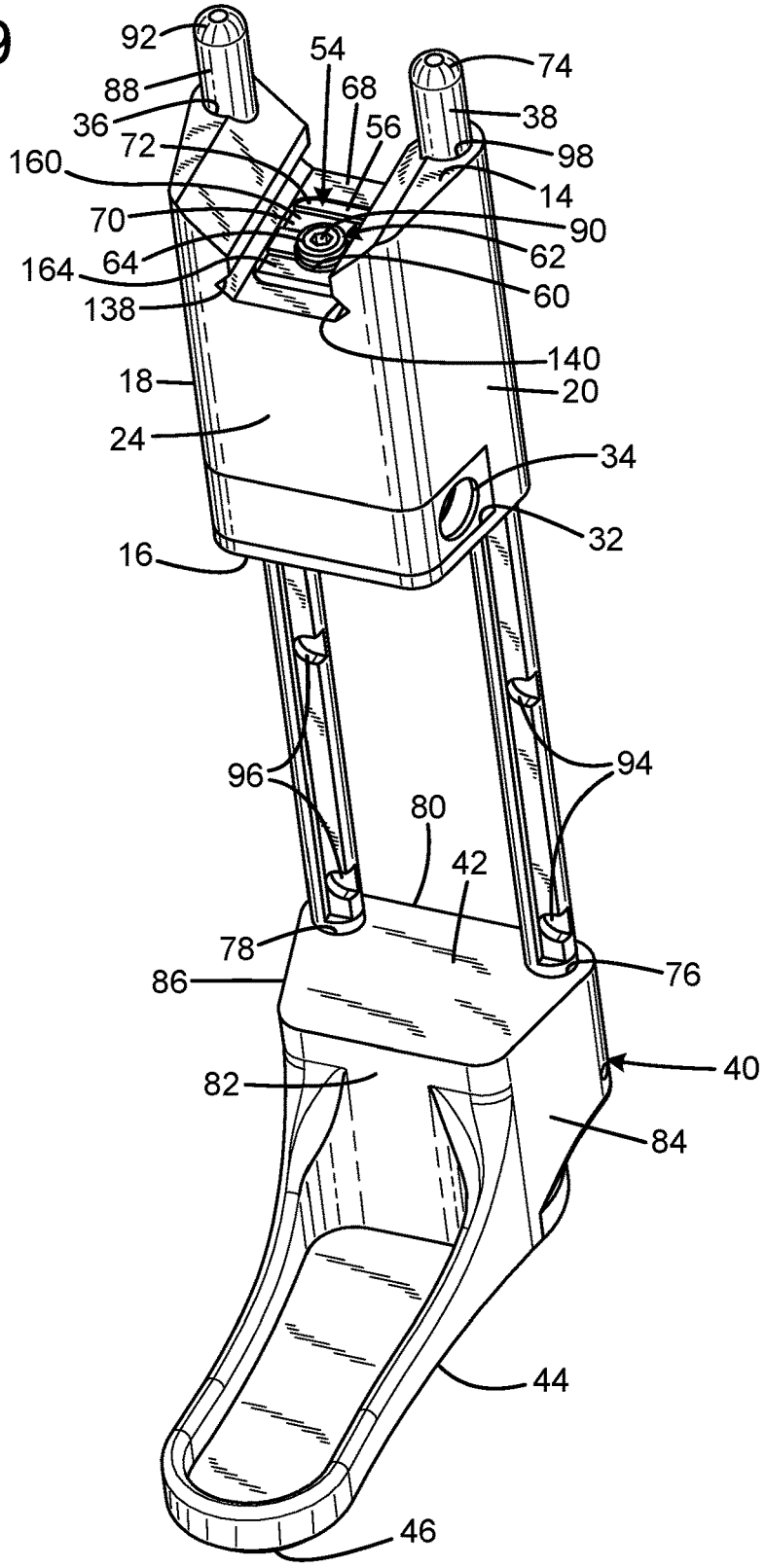
FIG. 9 is an isometric view of the current embodiment of the adjustable firearm stock of FIG. 1 with the stock body in the extended position.

FIGS. 1-9 illustrate the improved adjustable firearm stock 10 of the present invention. More particularly, the stock is shown attached to a firearm 100. The stock includes a body 12 and a shoulder stock with a butt 40 connected to the body. The body has a front 14, rear 16, right side 18, left side 20, top 22, and bottom 24. The body is manufactured from a block of aluminum in the current embodiment. The top rear of the body defines a lock button bore 26 that receives a lock button 28. The bottom rear of the body defines a right quick detach mount recess 30 and a left quick detach mount recess 32. A left quick detach mount 34 and a right quick detach mount (not visible) are received within the detach mount recesses to enable a sling (not shown) to be attached to the stock. The top rear of the body defines a right rod bore 36 and a left rod bore 98 that extend the length of the body. A left rod 38 and a right rod 154 (shown in FIGS. 7-8) are slidably received within the rod bores. The rods have a plurality of notches 94, 96 that the lock button engages to secure the shoulder stock with butt in a selected position selected from the extended position and the collapsed position. Additional optional notches in the rods can be used to secure the shoulder stock with butt in additional positions in between the extended position and the collapsed position. The lock button must be depressed to disengage the lock button from a set of notches in the rods to change the position of the butt. In the current embodiment, the length of pull is adjustable between 8 inches and 13.5 inches.

The shoulder stock with butt 40 is attached to one end of the left rod 38 and right rod 154. The shoulder stock with butt includes a front 42, rear 44, top 80, bottom 82, left side 84, and right side 86. A non-slip rear plate 46 is affixed to the rear of the butt to keep the stock 10 secure against the user's shoulder, even when the user is wearing body armor or other thick attire. Apertures 76, 78 on the top front of the shoulder stock with butt receive the rear ends (not visible) of the rods 38, 88 (shown in FIG. 8).

The front surface 14 of the body 12 defines a locking block recess 48 within a Picatinny rail slot 68. The Picatinny rail slot is an elongated channel open along its length in a selected direction. The channel is defined in the front surface of the body, and has a limited first width between opposed edge hook portions 138, 140 proximate the body front surface, and a greater second width internal to the channel, such that a Picatinny rail (such as Picatinny rail 128 on the firearm 100) closely received within the channel may be removed from the channel only by sliding the rail along the length of the channel. A set screw bore 50 having a bottom 52 is axially registered and in communication with the locking block recess. A locking block 54 is slidably received within the locking block recess. The locking block is a foot element having a front 56, rear 58, and defines a threaded set screw aperture 60 that is a threaded bore axially registered with the set screw bore. The opposed hook edge portions along the length of the Picatinny rail slot channel defined by the body each face the foot element. The set screw aperture receives a set screw 62, which has a flat head 64 and a base 66 that is received within the set screw bore. The flat head is a first end defining a tool facility 90 that faces in the selected direction the Picatinny rail slot opens in, and the base is an opposed second end contacting a screw contact surface of the stock body, which is the bottom of the set screw bore. The front contact surface of the locking block faces the selected direction the Picatinny rail slot opens in and defines a plurality of transverse rails 70 and slots 72 that conform to the Picatinny rail standard. The set screw aperture is aligned with a bore axis 170 perpendicular to the front contact surface of the locking block.

The firearm 100 includes an upper receiver 112 and a lower receiver 114. The upper receiver has a front 116, rear 118, left side 120, and right side (not visible). The rear of the left side defines a left slot 122 that receives the free end 74 of the left rod 38, and the rear of the right side defines a right slot (not visible) that receives the free end 92 of the right rod 88.

The lower receiver 114 includes a front 124, a rear 126, a left side 128, and a right side 130. The left rear of the lower receiver defines a left slot rear portion 148, and the right rear of the lower receiver defines a right slot rear portion 150. The left slot rear portion is aligned with the left slot 122, and the right slot rear portion is aligned with the right slot (not visible). The left slot rear portion and right slot rear portion enable the free end 74 of the left rod 38 and free end 92 of the right rod 88 to enter the left and right slots. The rear of the lower receiver includes a vertical Picatinny rail 136 having a plurality of transverse rails 132 and slots 134. The Picatinny rail is an elongated firearm rail having a rail profile with a neck portion 152 having a limited neck width and connected to the firearm, and a head portion 154 connected to the neck portion and having a greater head width, the head having a planar mounting surface 156 away from the neck. The Picatinny rail includes an alternating pattern of bars and slots/transverse rails and slots, and the front contact surface 56 of the foot/locking block 54 has at least a first ridge/transverse rail 70 adapted to mate with at least one of the slots of the Picatinny rail to prevent axial movement of the foot with respect to the Picatinny rail.

To install the stock 10 on the firearm 100, the user first separates the upper receiver 112 from the lower receiver 114. Next, the user removes the buffer (not shown) held in the rear 126 of the lower receiver by a hex key screw (not shown). Once the buffer and hex key screw are removed, a through hole/access aperture 136 in the rear of the upper receiver is exposed. The through hole/access aperture extends all the way through the rear of the upper receiver and the Picatinny rail 136. Then, the user inserts the locking block 54 into the locking block recess 48 in the front 14 of the stock body 12 and screws the set screw 62 into the set screw aperture 60 until the front contact surface 56 of the locking block is flush with the Picatinny rail slot 68 in the front of the body (the unlocked position shown in FIG. 6). The locking block is a foot element connected to the stock body, and the front contact surface faces the planar mounting surface 156 of the Picatinny rail. The locking block recess has an elongated floor surface 158 parallel to and opposing the planar mounting surface 156 of the Picatinny rail. Next, the user slides the vertical Picatinny rail on the rear of the lower receiver into the Picatinny rail slot on the stock body until the head 64 of the set screw/securement facility is axially registered/aligned with the through hole in the rear of the upper receiver and the Picatinny rail. The Picatinny rail slot provides a mounting facility to connect the stock body to the Picatinny rail and is an elongated channel having an internal width adapted to receive the width of the head portion 154 of the Picatinny rail. Subsequently, the user inserts an Allen wrench (not shown) through the through hole and rotates the set screw in a clockwise motion. As the set screw rotates within the set screw aperture, the base 66 of the set screw contacts the bottom 52 of the set screw bore, which pushes the locking block forward away from the body and tightens the front of the locking block against the Picatinny rail into the locked position shown in FIGS. 2-6. In the locked position, the upper block slot surface 160 and lower block slot surface 164 transmit a compressive force to the upper receiver rail surfaces 162 and 166. The set screw is a securement facility operably connected to the locking block/foot element and to the stock body, and is operable to move the foot element with respect to the stock body and to compress the Picatinny rail between the front contact surface of the foot and the hook surfaces/opposed edge hook portions 138, 140. The screw contact surface, which is the bottom of the set screw bore, is parallel to the elongated floor surface and faces the same direction as the elongated floor surface. The rails 70 of the locking block are received within the slots 134 of the Picatinny rail, and the rails 132 of the Picatinny rail are received within the slots 72 of the locking block. Once the set screw is tightened, the body is firmly secured to the Picatinny rail. The locking block pushes away from the stock body and creates pressure against the middle face 146 of the Picatinny rail, which also causes the elongated hook surfaces/edges of the stock body that define the hook width of the Picatinny rail slot that is adapted to receive the neck portion 152 of the Picatinny rail to pull on the edges 142, 144 of the Picatinny rail. The pulling force exerted upon the edges of the Picatinny rail creates the strength of the connection between the Picatinny rail and the stock body. After the set screw is tightened, the buffer (not shown) and hex key screw (not shown) are replaced within the lower receiver so the firearm will function properly. Then the upper receiver is reattached to the lower receiver, which completes the stock installation procedure. The hook width is less than the head width such that the hook surfaces/opposed edge hook portions bear on the Picatinny rail to resist separation of the body from the Picatinny rail in a direction perpendicular to the planar mounting surface. When the stock body is installed on the firearm, the shoulder stock with butt 40 must always be in the fully extended position when separating or assembling the upper receiver and lower receiver so the free ends 74, 92 of the rods 38, 88 do not obstruct the upper receiver.

In the current embodiment, the firearm 100 is a SIG MPX manufactured by Sig Sauer, Inc. of Newington, N.H. However, the current invention is also compatible with the SIG MCX also manufactured by Sig Sauer, Inc. of Newington, N.H. by changing the location of the set screw aperture 60 in the locking block 54 and the set screw bore 50 in the body 12 to an offset position to match the offset through hole in the rear of the SIG MCX lower receiver and Picatinny rail. The SIG MCX installation procedure also has an additional initial step compared to the SIG MPX installation procedure because the SIG MCX has a manufacturer-supplied stock that must be removed prior to installing the stock 10.

While a current embodiment of an adjustable firearm stock has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mounting facility for connecting to an elongated firearm rail having a rail profile with a neck portion having a neck width and connected to a firearm, and a head portion connected to the neck portion and having a head width greater than the neck width, the head portion having a planar mounting surface away from the neck portion, the mounting facility comprising:

a body defining an elongated channel adapted to receive the elongated firearm rail;

the elongated channel having an internal width adapted to receive the head portion of the elongated firearm rail;

the elongated channel having opposed elongated hook surfaces defining a hook width adapted to receive the neck portion of the elongated firearm rail;

the hook width being less than the head width of the head portion such that the hook surfaces bear on the elongated firearm rail to resist separation of the body from the elongated firearm rail in a direction perpendicular to the planar mounting surface;

the elongated channel having an elongated floor surface parallel to and opposing the planar mounting surface of the elongated firearm rail;

a foot element connected to the body and having a contact surface facing the planar mounting surface of the elongated firearm rail;

the foot element defining a threaded bore;

a threaded securement facility threadably received in the threaded bore and having an end face adapted to contact the body, and operable to move the foot element with respect to the body and to compress the elongated firearm rail between the contact surface of the foot element and the hook surfaces.

2. The mounting facility of claim 1 wherein the securement facility is a screw.

3. The mounting facility of claim 2 wherein the body has a screw contact surface adapted to face the planar mounting surface of the elongated firearm rail, and wherein the end face of the screw is adapted to contact the screw contact surface.

4. The mounting facility of claim 3 wherein the body defines a recess, and wherein the screw contact surface comprises a floor of the recess.

5. The mounting facility of claim 2 wherein the securement facility is a set screw having a first end defining a tool facility and an opposed second end contacting a screw contact surface of the body.

6. The mounting facility of claim 5 wherein the screw contact surface is parallel to the elongated floor surface.

7. The mounting facility of claim 5 wherein the screw contact surface faces the same direction as the elongated floor surface.

8. The mounting facility of claim 1 wherein the foot element defines a threaded bore receiving the securement facility.

9. The mounting facility of claim 1 wherein the securement facility is aligned with the threaded bore in the rail.

10. The mounting facility of claim 1 wherein the rail includes an alternating pattern of bars and slots, and the contact surface of the foot element has at least a first ridge adapted to mate with at least one of the slots to prevent axial movement of the foot element with respect to the rail.

11. The mounting facility of claim 1 wherein the rail defines an access aperture, and wherein the securement facility is registered with the access aperture.

12. The mounting facility of claim 1 wherein the rail is connected to a rear portion of a firearm, and including a shoulder stock connected to the body.

13. An accessory mount for connecting to a firearm rail, comprising:

a body defining a channel open in a selected direction and having a screw engagement surface facing the selected direction;

a foot element in the channel and having a contact surface facing the selected direction;

the foot element defining a threaded bore aligned with a bore axis perpendicular to the contact surface;

a set screw received in the threaded bore and having a first end facing the selected direction and having a tool-engagement facility; and the set screw having an opposed second end adapted for contacting the screw engagement surface of the body, such that adjustment of the set screw secures the body to the firearm rail by way of pressure applied by the foot element and resisted by selected portions of the body contacting the firearm rail.

14. The accessory mount of claim 13 wherein contact surface of the foot has at least a first ridge adapted to mate with a slot in the firearm rail to prevent axial movement of the foot with respect to the firearm rail.

15. The accessory mount of claim 13 wherein the channel is adapted to closely receive a Picatinny rail.

16. The accessory mount of claim 13 wherein the channel is elongated and open along its length.

17. The accessory mount of claim 13 wherein the channel is defined in a body surface, and has a limited first width between opposed edge hook portions proximate the body surface, and a greater second width internal to the channel, such that a rail closely received within the channel may be removed from the channel only by sliding the rail along the length of the channel.

18. The accessory mount of claim 13 wherein the body defines opposed hook portions along the length of the channel, each hook portion facing the foot element.

19. A mounting facility for connecting to an elongated firearm rail having a rail profile with a neck portion having a neck width and connected to a firearm, and a head portion connected to the neck portion and having a head width greater than the neck width, the head portion having a planar mounting surface away from the neck portion, the mounting facility comprising:

a body defining an elongated channel adapted to receive the elongated firearm rail;

the elongated channel having an internal width adapted to receive the head portion of the elongated firearm rail;

the elongated channel having opposed elongated hook surfaces defining a hook width adapted to receive the neck portion of the elongated firearm rail;

the hook width being less than the head width of the head portion such that the hook surfaces bear on the elongated firearm rail to resist separation of the body from the elongated firearm rail in a direction perpendicular to the planar mounting surface;

the channel having an elongated floor surface parallel to and opposing the planar mounting surface of the elongated firearm rail;

a foot element connected to the body and having a contact surface facing the planar mounting surface of the elongated firearm rail;

a securement facility operably connected to the foot element and to the body, and operable to move the foot element with respect to the body and to compress the elongated firearm rail between the contact surface of the foot element and the hook surfaces; and wherein the foot element defines a threaded bore receiving the securement facility.

* * * * *